US008213664B2

(12) United States Patent
Fyke et al.

(10) Patent No.: US 8,213,664 B2
(45) Date of Patent: Jul. 3, 2012

(54) SHAPE-ADAPTABLE SURFACE FOR AN AUDIO PORT

(75) Inventors: Steven Henry Fyke, Waterloo (CA); Norman Miner Ladouceur, Waterloo (CA); Jason Tyler Griffin, Waterloo (CA)

(73) Assignee: Research In Motion Limited, Waterloo (CA)

( * ) Notice: Subject to any disclaimer, the term of this patent is extended or adjusted under 35 U.S.C. 154(b) by 427 days.

(21) Appl. No.: 12/609,317

(22) Filed: Oct. 30, 2009

(65) Prior Publication Data

US 2011/0103631 A1 May 5, 2011

(51) Int. Cl.
*H04R 25/00* (2006.01)

(52) U.S. Cl. ..... 381/372; 381/370; 381/371

(58) Field of Classification Search ..... 381/370, 381/371, 372

See application file for complete search history.

(56) References Cited

U.S. PATENT DOCUMENTS

2009/0003641 A1 1/2009 Van Der Bilt

FOREIGN PATENT DOCUMENTS

| | | |
|---|---|---|
| EP | 1569422 | 8/2005 |
| JP | 63-156498 | 10/1988 |
| JP | 2007-180733 | 7/2007 |
| WO | 2008/124335 | 10/2008 |

OTHER PUBLICATIONS

European Search Report 09174709.7; dated Feb. 18, 2010.

*Primary Examiner* — Davetta W Goins
*Assistant Examiner* — Amir Etesam
(74) *Attorney, Agent, or Firm* — Fitch, Even, Tabin & Flannery, LLP

(57) ABSTRACT

A method and apparatus for providing a shape-adaptable surface for an audio port of a device includes an audio port, a shape-adaptable surface having a plurality of portions, a plurality of sensors coupled to the shape-adaptable surface, wherein the plurality of sensors are operative to sense a plurality of distances between the object and the shape-adaptable surface, and a processor operatively coupled to the shape-adaptable surface and the plurality of sensors, said processor configured to control some of the plurality of portions of the shape-adaptable surface to adjust the plurality of distances and to provide a channel between a sound receiver of the object and the audio port. An improved audio coupling is formed by adjusting the distances between the shape-adaptable surface and the object, thereby transmitting sounds directly from the audio port of the device to a sound receiver of the object.

19 Claims, 11 Drawing Sheets

SHAPE-ADAPTABLE SURFACE FOR AN AUDIO PORT

FIELD OF TECHNOLOGY

The present disclosure relates generally to audio ports of electronic devices. More specifically, the present disclosure relates to shape-adaptable surfaces for audio ports of electronic devices.

BACKGROUND

With the advent of more robust audio electronic systems, advancements of electronic devices are becoming more prevalent. Electronic devices can provide a variety of functions including, for example, telephonic, audio/video, and gaming functions. Handheld electronic devices can include mobile stations such as cellular telephones, smart telephones, portable gaming systems, audio headphones, wireless headsets for cellular phones, handheld video players, handheld audio players, audio headphones, and portable MP3 players.

Some electronic devices can include a speaker portion having an audio port that provides sound to a user of the device. For example, the device may have an audio port on a substantially flat surface of the device. The substantially flat surface of the device is then held against the user's head to align the audio port with the user's ear. However, because the user's ear is not flat in shape, gaps form between the surface of the device and the user's ear. As a result, some of the sound delivered by the audio port dissipates through the gaps, thereby reducing sound quality.

In other electronic devices, the speaker portion having an audio port can be made of a deformable material, such as a foam, an elastomeric, a soft rubber material, or a gel. When an object contacts and exerts pressure on the speaker portion, the speaker portion deforms to cushion the object and to equalize pressure between the speaker portion and the object. With such devices, the speaker portion might not deform enough to create a sufficient audio coupling, thereby resulting in gaps between the object and the deformable material. Again, such gaps can reduce sound quality. Contrastingly, some devices have deformable surfaces that are so deformable that the deformable material makes a complete seal with the ear such that no gaps exist between the user's ear and the surface of the device. For example, such a situation can occur if the device is misaligned with the ear. If the seal is so complete, sound cannot travel well from the audio port of the device to the user's ear because the lack of any gaps blocks or muffles the sound.

BRIEF DESCRIPTION OF THE DRAWINGS

Embodiments of the present application will now be described, by way of example only, with reference to the attached Figures, wherein.

DETAILED DESCRIPTION

Figure 1:
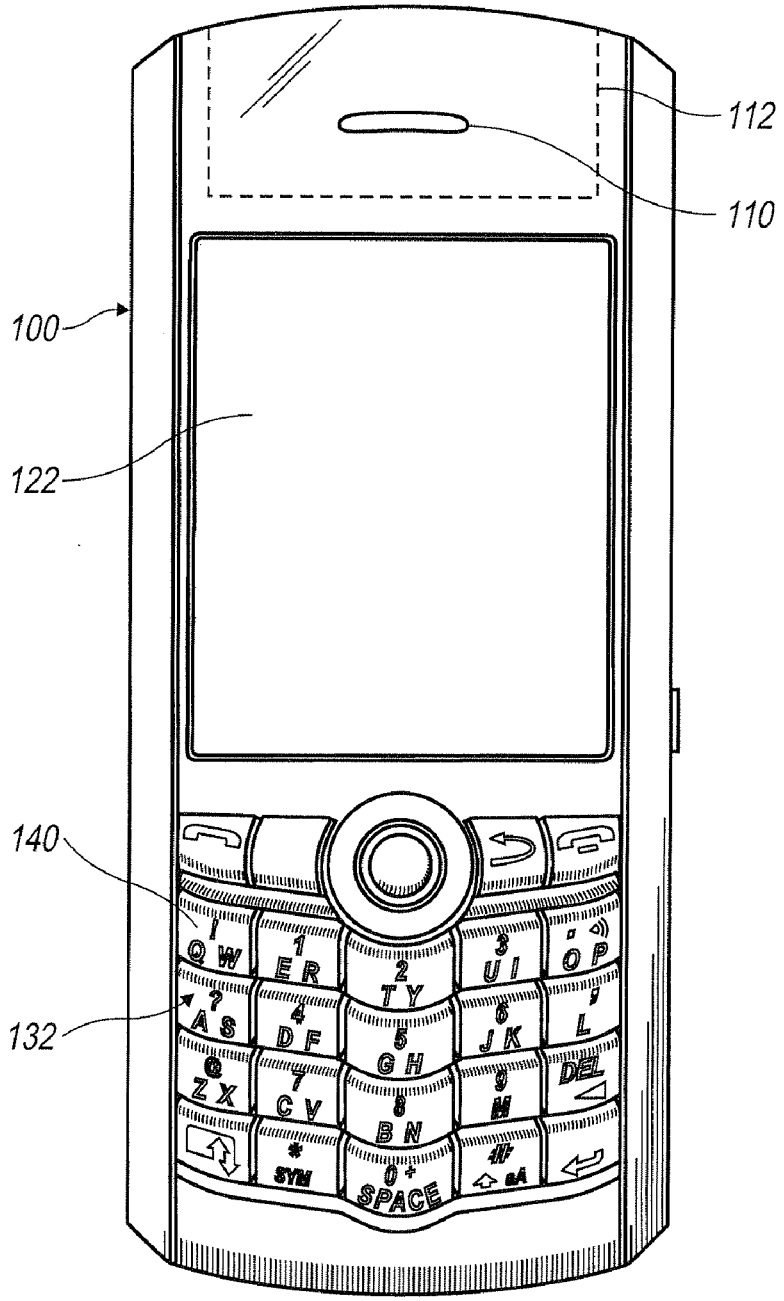
FIG. 1 is an exemplary handheld communication device having a shape-adaptable surface for the audio port in accordance with an exemplary embodiment.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein.

The following figures describe a shape-adaptable surface for an audio port. While the following description describes the shape-adaptable surface in relation to an audio port for a handheld mobile communication device, one of ordinary skill in the art will appreciate that the shape-adaptable surface can be implemented with audio ports for portable speakers, headphones, radio-transmitting head phones, gaming chairs having speakers positioned at the head of the chair, audio earphones, portable handheld gaming devices, portable handheld audio devices, or the like.

Figure 2:
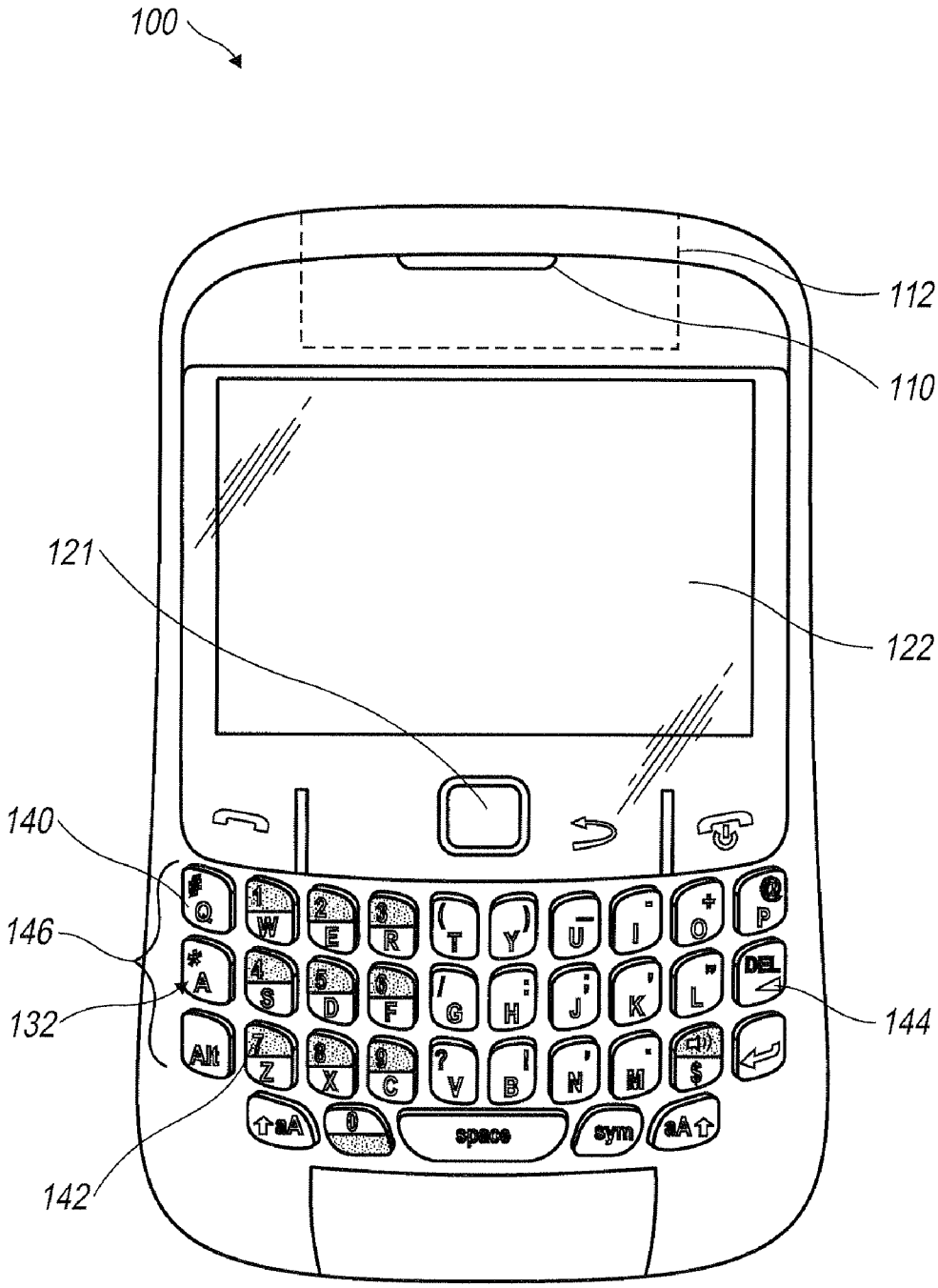
FIG. 2 is another exemplary handheld communication device having a shape-adaptable surface for the audio port in accordance with an exemplary embodiment.

Referring to FIGS. 1 and 2, exemplary handheld communication devices 100 having a shape-adaptable surface 112 for an audio port 110 in accordance with an exemplary embodiment are illustrated. In FIGS. 1 and 2, the communication device 100 is illustrated including a body housing a display screen 122, a processor module (not pictured), the audio port 110, and a keyboard 132 comprising a keyfield having alphanumeric keys 140 arranged in a keyboard layout 146, numeric keys 142, and other function keys 144. While the illustrated embodiment shows the communication device 100 is a handheld wireless communication device, in other embodiments, the communication device 100 can comprise a personal digital assistant (PDA), handheld electronic devices, wireless communication devices, cellular phones, cellular smart-phones, and wireless organizers. While FIGS. 1 and 2 depict the keyboard 132 having depressible alphanumeric keys 140, numeric keys 142, and function keys 144, in other embodiments, the keyboard 132 can be displayed on a dynamic touch display comprising the display screen 122 and a touch location sensor (not shown). Also illustrated in FIGS. 1 and 2, the surface of the front face of the handheld communication device 100 includes the shape-adaptable surface 112 that surrounds and is operatively coupled with the audio port 110. The audio port 110 can be a speaker port or any other element that can transmit or reproduce sound.

Figure 3:
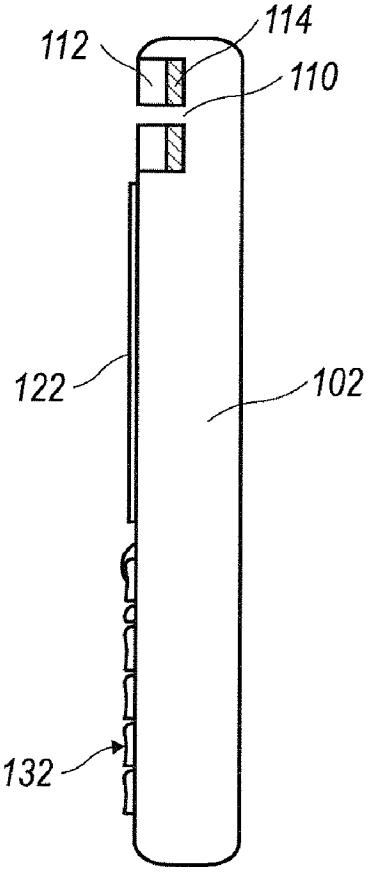
FIG. 3 is a side view of the exemplary handheld communication device illustrated in FIG. 1 showing the cross-section view of the audio port having a shape-adaptable surface in accordance with an exemplary embodiment.

FIG. 3 is a side view of the handheld communication device 100 depicted in FIG. 1 showing a cross-section view of the audio port 110. The audio port 110 is coupled to a sensor 114 which is in turn coupled to the shape-adaptable surface 112. As seen in FIG. 3, the shape-adaptable surface 112 is integrated with a housing 102 of the device 100. While the source of sound generation is not shown, the audio port 110 can be coupled to a speaker, an audio sound system, or other sound generation device.

Figure 4:
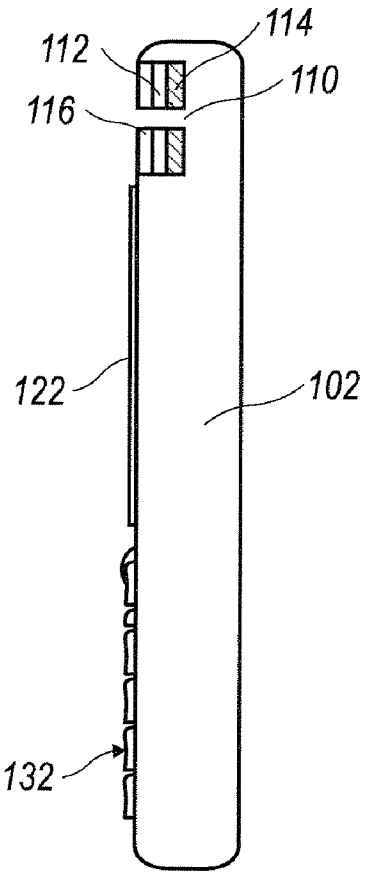
FIG. 4 is a side view of the exemplary handheld communication device illustrated in FIG. 1 showing the cross-section view of the audio port having a shape-adaptable surface having an outer surface in accordance with an alternative exemplary embodiment.

In an alternative embodiment, as illustrated in FIG. 4, the shape-adaptable surface 112 can also be coupled an outer surface 116. For example, the outer surface 116 can be a flexible material that can conform to the shape-adaptable surface 112. Additionally, the outer surface 116 can be a flexible material that matches the color and texture of the housing 102 of the device 100, thereby concealing the shape-adaptable surface 112. In alternative embodiments, the outer surface 116 can be a cover, a binding layer, or other surface that allows the shape-adaptable surface to be held together with the sensors 114 and the audio port 110. While the source of sound generation is not shown, the audio port 110 can be coupled to a speaker, an audio sound system, or other sound generation device. In at least another embodiment, the audio port 110 and the sound generation device can be assembled as one unit.

Figure 5:
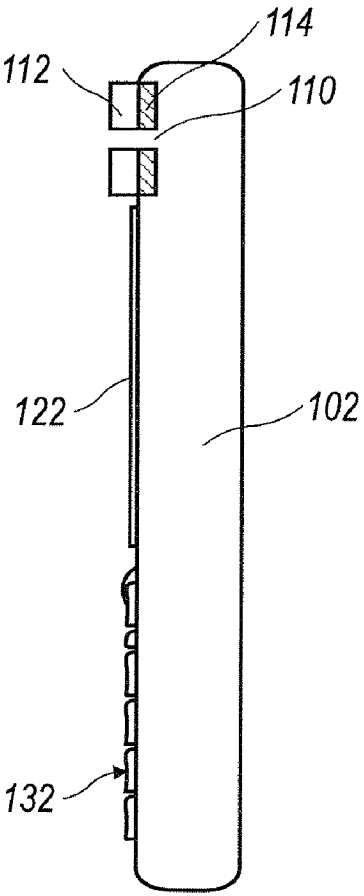
FIG. 5 is a side view of the exemplary handheld communication device illustrated in FIG. 1 showing the cross-section view of the audio port having a shape-adaptable surface in accordance with an alternative exemplary embodiment.

In the alternative embodiment illustrated in FIG. 5, the shape-adaptable surface 112 can be disposed on the surface of the housing 102 of the device 100. While the source of sound generation is not shown, the audio port 110 can be coupled to a speaker, an audio sound system, or other sound generation device. In at least another embodiment, the audio port 110 and the sound generation device can be assembled as one unit.

Figure 6A:
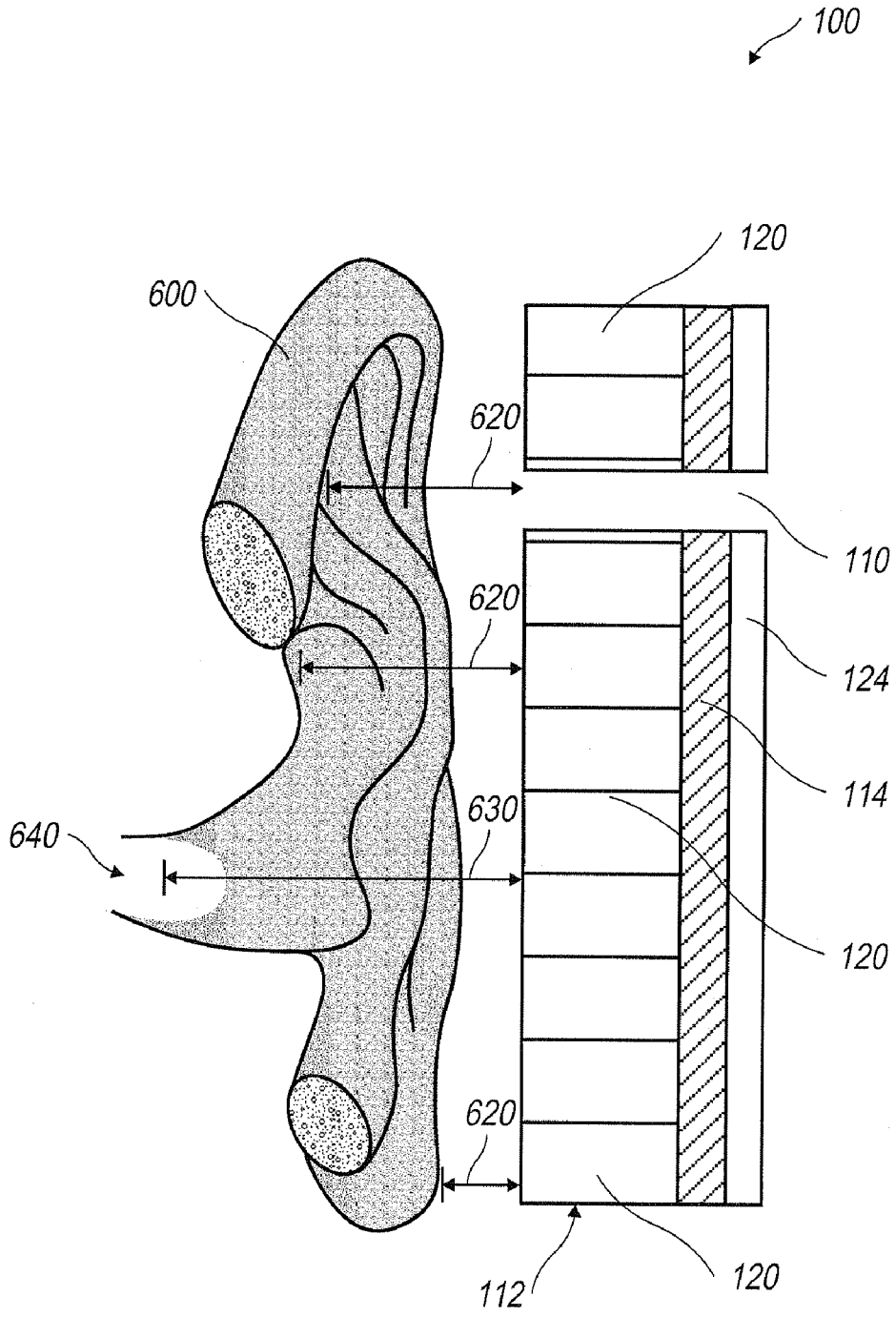
FIG. 6A is a partial side cross-section view of the exemplary handheld communication device illustrated in FIG. 1 in accordance with an exemplary embodiment where the shape-adaptable surface has not been activated.
Figure 6B:
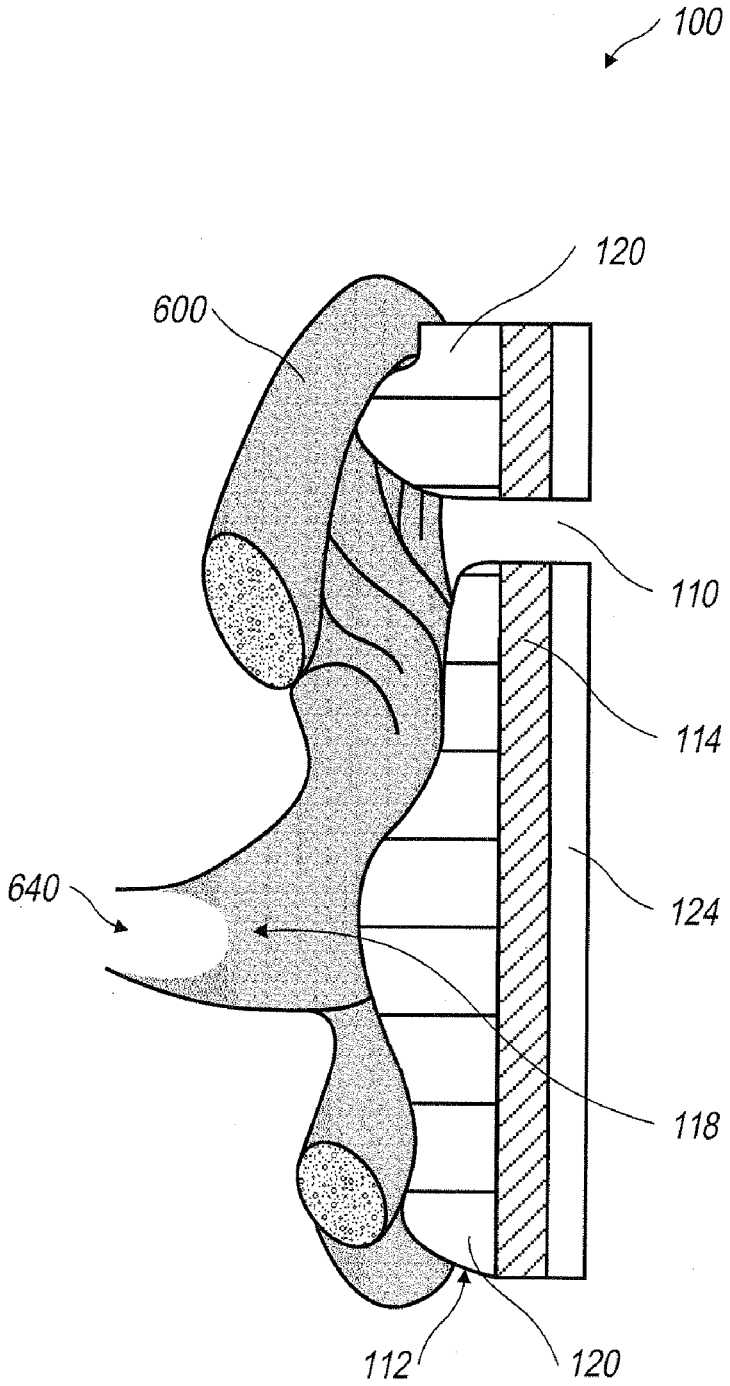
FIG. 6B is a partial side cross-section view of the exemplary handheld communication device illustrated in FIG. 1 in accordance with an exemplary embodiment where the shape-adaptable surface has been activated.
Figure 6C:
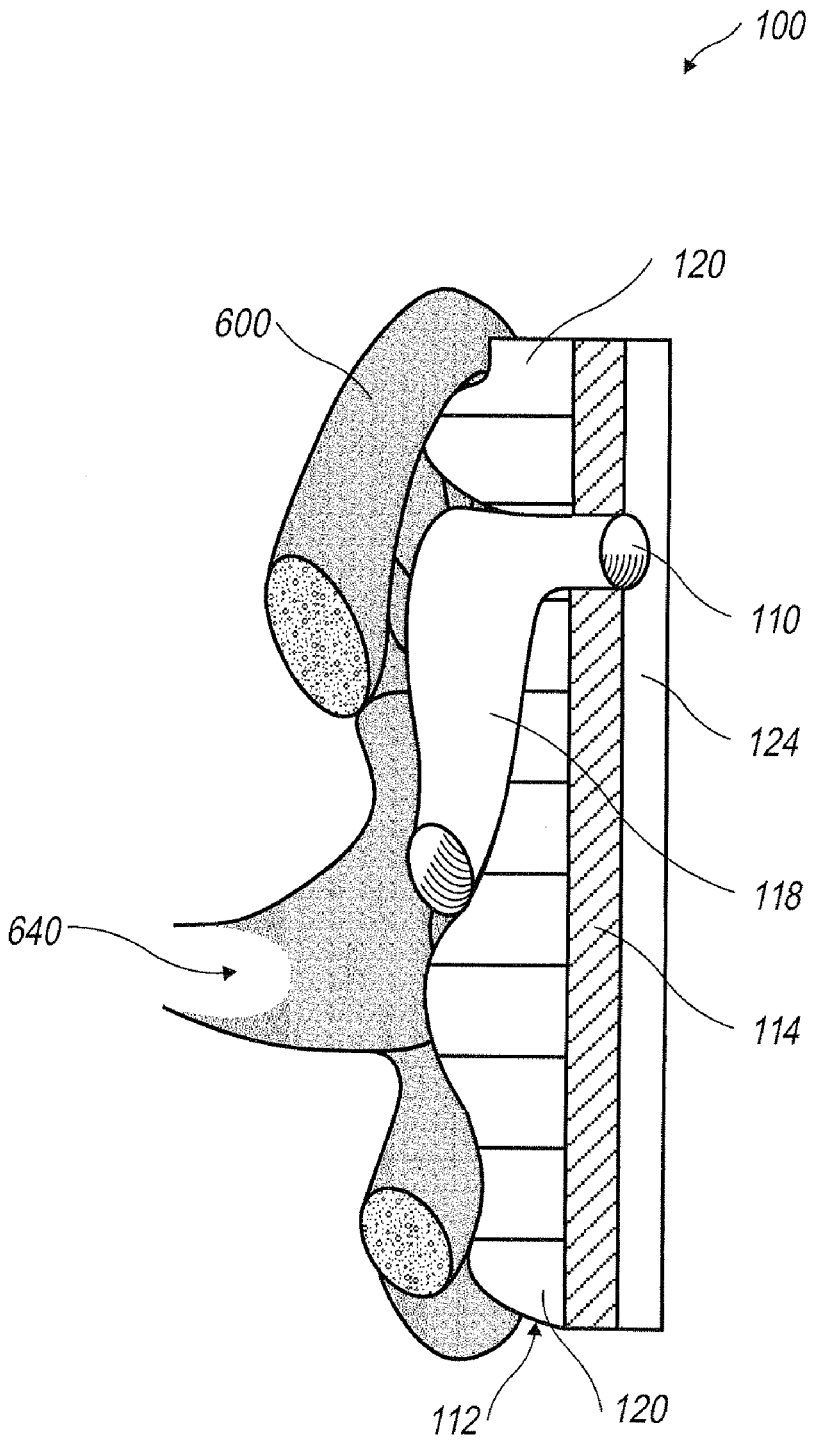
FIG. 6C is a partial top cross-section view of the exemplary handheld communication device illustrated in FIG. 1 in accordance with an exemplary embodiment where the shape-adaptable surface has been activated.

FIGS. 6A-6C are partial cross-section views of the speaker portion of the handheld communication device 100 of FIG. 1. As illustrated in FIGS. 6A-6C, the device 100 comprises a layer of shape-adaptable surface 112 having a plurality of portions 120, a layer of a plurality of sensors 114 coupled to the shape-adaptable surface 112, the audio port 110 of the device 100, and a processor (not shown) operatively coupled to the shape-adaptable surface 112 and to the sensors 114. The plurality of sensors 114 are operative to sense a plurality of distances 620, 630 between an object 600, for example an ear, in spaced relation to the device 100 and the shape-adaptable surface 112. While a separate layer of sensors 114 is illustrated, in alternative embodiments, the sensors 114 can be integrated with the shape-adaptable surface 112 or can be disposed on top or beneath the shape-adaptable surface 112. The processor is configured to control some of the plurality of portions 120 of the shape-adaptable surface 112 to adjust the plurality of distances 620, 630 between the object 600 in spaced relation to the device 100 and the portions of the shape-adaptable surface 112. The processor can also be configured to control the shape-adaptable surface 112 to provide a channel 118 between a sound receiver 640 of the object 600 and the audio port 110 of the device 100. By controlling the shape-adaptable surface 112 and adjusting the distances 620, 630 between the shape-adaptable surface 112 and the object 600, the audio coupling between the object 600 and the audio port 110 is enhanced. For example, the channel 118 can result in improved sound quality and sound delivery from the audio port 110 to the sound receiver 640 of the object 600. As the channel 118 couples the audio port 110 to the sound receiver 640, the transfer of sound waves is enhanced by allowing the sound waves to travel more effectively and without significant distortion to the sound receiver 640.

FIG. 6A is a partial cross-section view of a portion of the handheld communication device 100 having an object 600 in spaced relation to the shape-adaptable surface 112, where the shape-adaptable surface has not been activated. The object 600 illustrated in FIG. 6A is an ear. The illustrated portion of the handheld communication device 100 is the speaker portion of the device 100. The cross-section of the speaker portion of the device 100 can include the audio port 110 coupled to a sound generation device (not shown). The audio port 110 delivers sound from the sound generation device to the sound receiver 640 of an object in spaced relation to the device 100. In FIG. 6A, the audio port 110 delivers sound from the sound generation device to the ear canal. In the illustrated embodiment, the layer of sensors 114 can be displaced around the audio port 110. In an alternative embodiment, the audio port 110 can be integrated with the sensors 114. As illustrated, the layer of shape-adaptable surface 112 is disposed on top of the layer of sensors 114. In an alternative embodiment, the shape-adaptable surface 112 and the sensors 114 can be integrated into one layer or the layer of sensors 114 can be disposed on top of the shape-adaptable surface 112. In such embodiments, the sensors 114 can be constructed from a suitable flexible material to accommodate the flexibility of the shape-adaptable surface 112.

Still referring to the embodiment illustrated in FIG. 6A, the shape-adaptable surface 112 can have the plurality of portions 120. In alternative embodiments, the shape-adaptable surface 112 can be a single layer without the plurality of portions. FIG. 6A illustrates the shape-adaptable surface 112, the sensors 114, and the audio port 110 disposed on a support surface 124. The support surface 124 can be a PCB board, a metal support surface, a rubber support surface, or other type of support surface. FIG. 6A also illustrates the spatial relation between the ear 600 and the handheld communication device 100. As illustrated, the ear 600 has at least one of protrusions, valleys, ridges, convex portions, and concave portions. Reference numerals 620 and 630 refer to the plurality of distances between points on the ear and the shape-adaptable surface 112. The plurality of distances 620, 630 will vary depending on the points on the protrusions, valleys, ridges, convex portions, and concave portions of the ear 600 that are sensed by the sensors 114. The distance between the ear canal (the sound receiver 640 of the ear) and the shape-adaptable surface 112 is noted as reference numeral 630. In FIG. 6A, the shape-adaptable surface 112 has not been activated, so the shape-adaptable surface 112 has not yet been controlled to reduce the distances 620, 630 between the points of the ear 600 and the shape-adaptable surface 112 or controlled to form a channel between the audio port 110 and the sound receiver 640 of the ear.

FIG. 6B is a partial cross-section view of a portion of the handheld communication device 100 illustrated in FIG. 6A having an object 600 in spaced relation to the shape-adaptable surface 112, where the shape-adaptable surface has been activated. As illustrated, portions 120 of the shape-adaptable surface 112 have been controlled to adjust the plurality of distances 620, 630 between the ear 600 and the shape-adaptable surface 112. The plurality of portions 120 has also been controlled to form a channel 118 between the sound receiver 640 and the audio port 110.

FIG. 6C is a partial top cross-section view of a portion of the handheld communication device 100 illustrated in FIG. 6B having the object 600 in spaced relation to the shape-adaptable surface 112, where the shape-adaptable surface 112 has been activated. As illustrated, portions 120 of the shape-adaptable surface 112 have been controlled to adjust the plurality of distances 620, 630 between the ear 600 and the shape-adaptable surface 112. The plurality of portions 120 has also been controlled to form a channel 118 between the sound receiver 640 and the audio port 110. In a top view, the channel 118 can be formed in a straight line, a curve, a series of line segments, or as needed to allow sound to travel between the audio port 110 and the sound receiver 640.

Figure 6D:
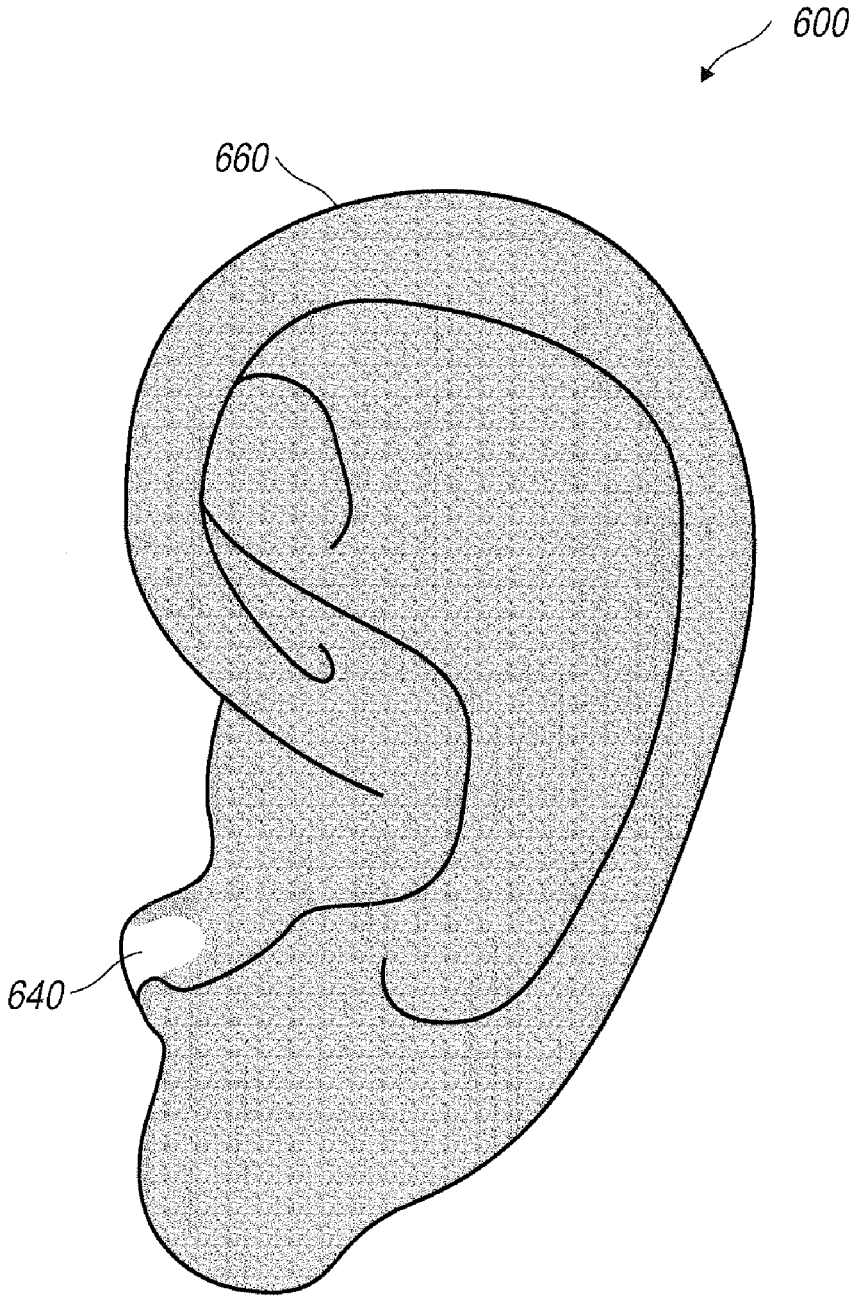
FIG. 6D is a front plan view of an object that can be spaced from a device having a shape-adaptable surface for an audio port.

FIG. 6D is a front plan view of the object 600 that is an ear. The object 600 can have a perimeter 660 which can be sensed by sensors 114 of the shape-adaptable surface 112 for the audio port 110 when the object 600 is in spaced relation to the device 100 having the shape-adaptable surface 112.

Figure 6E:
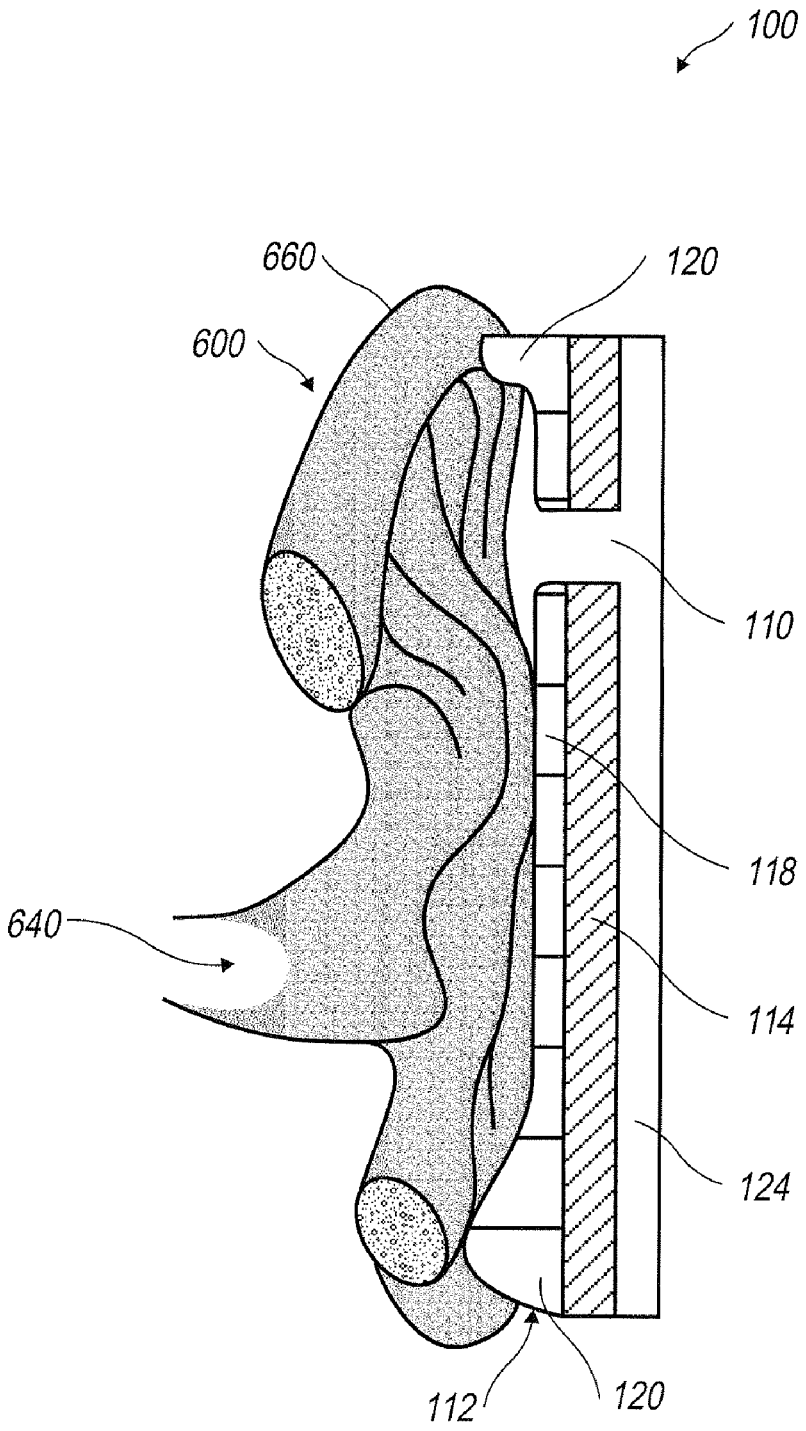
FIG. 6E is a partial top cross-section view of the exemplary handheld communication device illustrated in FIG. 1 in accordance with another exemplary embodiment where the shape-adaptable surface has been activated.

FIG. 6E is a partial top cross-section view of a portion of the handheld communication device 100 illustrated in FIG. 6A having the object 600 in spaced relation to the shape-adaptable surface 112, where the shape-adaptable surface 112 has been activated. In the illustrated embodiment, the shape-adaptable surface 112 has been activated and controlled to adjust the plurality of distances 620, 630 between the perimeter 660 of the object 600 and the shape-adaptable surface 112.

Figure 7:
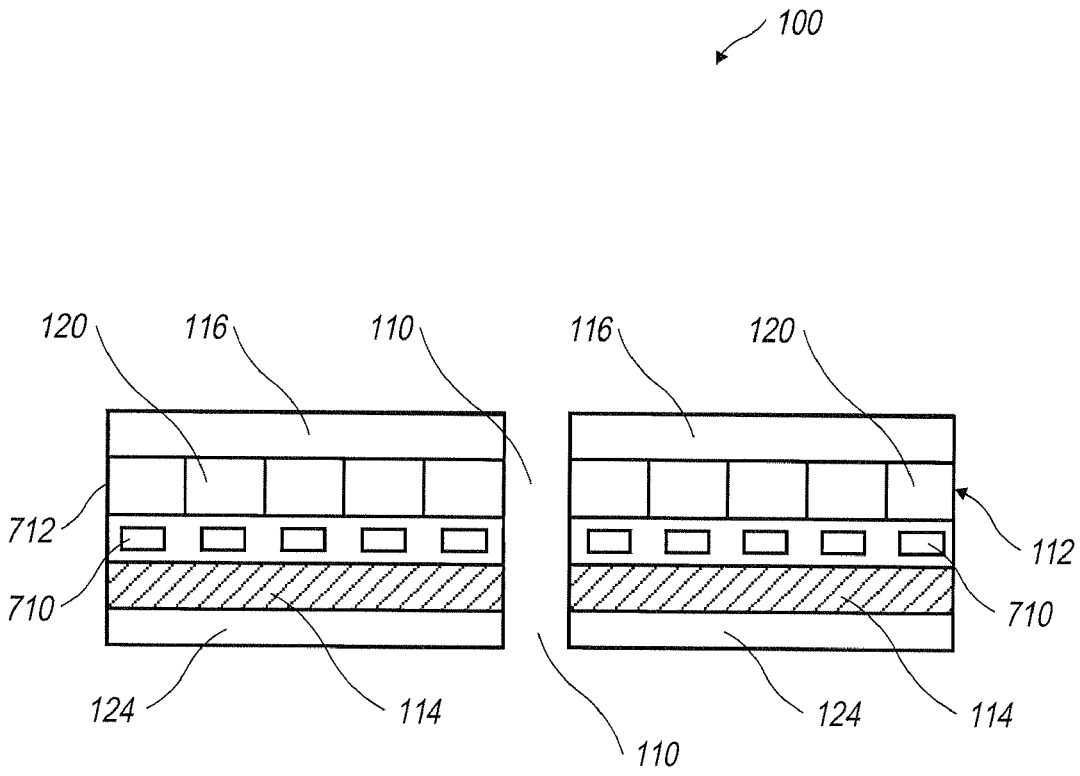
FIG. 7 is a cross-section view of the shape-adaptable surface in accordance with an exemplary embodiment.

FIG. 7 is a cross-sectional view of an alternative embodiment of the shape-adaptable surface 112 for an audio port 110. FIG. 7 illustrates a portion of the handheld communication 100 device having the shape-adaptable surface 112 that comprises an electroactive polymer layer 712 or film. In other alternative embodiments, the shape adaptable surface 112 can comprise a shape memory alloy, a flexible skin or gel having a mechanical actuation structure, a flexible skin having a hydraulic actuation structure, a flexible skin having an expandable gas actuation structure, or the like. In some embodiments, the shape-adaptable surface 112 can include a control portion 710. In the exemplary embodiment illustrated in FIG. 7, the control portion 710 is a layer having an array of electrodes. In at least one embodiment, the electrodes can be operatively coupled to the sensors 114 and the shape-adaptable surface 112. With the particular exemplary embodiment illustrated in FIG. 7, in response to the sensed distances between an object and the shape-adaptable surface 112, the processor can control the shape-adaptable surface 112 and send signals to the control portion 710 to actuate particular electrodes, thereby activating and shaping portions of the electroactive polymer film 712 and creating an acoustical connection or coupling between the object 600 and the audio port 110. The shape-adaptable surface 112 can also include an outer surface 116 that provides for small changes in shape. For example, the outer surface 116 can be a relatively thin foam or gel layer. With the outer surface 116, the processor can activate portions of the electroactive polymer layer 712 to change shape. As a result, the activated portions of the electroactive polymer film 712 will rise up, push against, and push through the portions of the outer surface 116 to create ridges or convex shapes in the outer surface 116. The ridges and convex shapes then contact the object 600, such as an ear, to create a suitable acoustical connection between the object 600 and the audio port 110.

In alternative embodiments, the control portion 710 can be interlaced within the shape-adaptable surface 112 or integrated with the shape-adaptable surface 112. For example, the control portion 710 can be an array of electrodes interlaced within flexible material, such as polyurethane, rubber, gel, or silicone. With such flexible material, the intersection of the columns and the rows of electrodes can form pockets which provide a frame for the shape-adjustable layer 112 to create shapes when activated. Thus, when the processor controls the shape-adaptable layer 112, the processor can transmit signals to the control portion 710, thereby activating some of the electrodes to create shapes within the flexible material. Alternatively, the control portion 710 can be constructed using MEMS (microelectrical mechanical structures), expandable gas actuation structures, hydraulic actuation structures, or a shape memory alloy structure.

Figure 8:
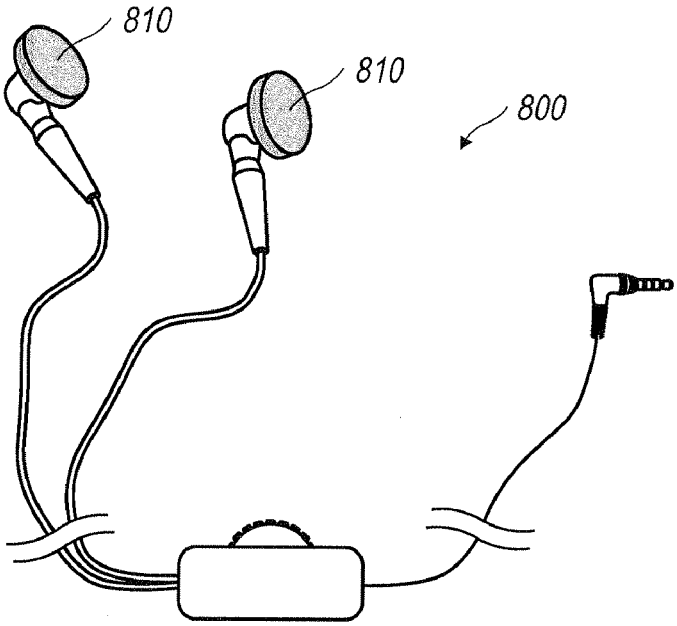
FIG. 8 is another exemplary device having a shape-adaptable surface for an audio port.
Figure 9:
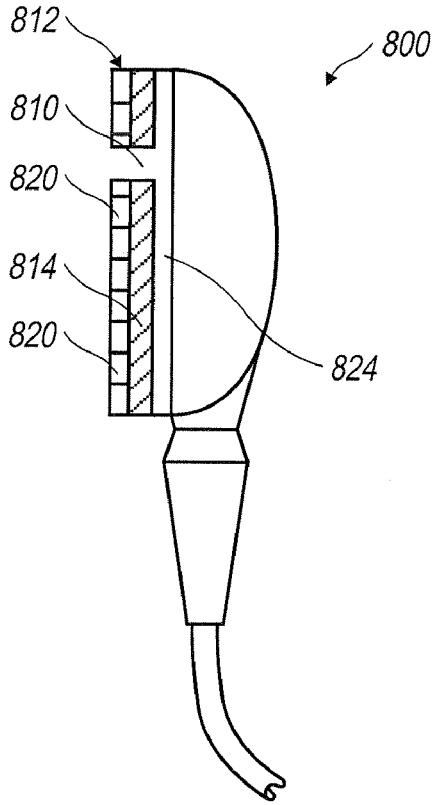
FIG. 9 is a side cross-section view of the exemplary device illustrated in FIG. 8.

FIG. 8 is an alternative embodiment of a shape-adaptable surface for an audio port. FIG. 8 illustrates a pair of ear phones 800 having a shape-adaptable surface 812 on each of the ear phone pieces. FIG. 9 is a cross-sectional view of one of the ear phone 800 pieces. The ear phone 800 piece includes an audio port 810, the shape-adaptable surface 812 that has a plurality of portions 820 and that is coupled to a plurality of sensors 814, and a processor (not shown) coupled to the shape-adaptable surface 812 and to the plurality of sensors 814. The sensors 814 can be disposed on a support surface 824 such as a PCB board, rubber surface, metal plate, or the like. The sensors 814 are coupled to the shape-adaptable surface 812 and operative to sense a plurality of distances between an object in spaced relation to the ear phone 800 piece and the shape-adaptable surface 812. The processor is operatively coupled to the shape-adaptable surface 812 and to the plurality of sensors 814 and configured to control a plurality of portions 820 of the shape-adaptable surface 812 to adjust the plurality of distances between the object and the shape-adaptable surface 812 and to provide a channel between the sound receiver of the object and the audio port 810 of the ear phone 800 pieces. The same method of increasing the audio coupling between an object and an audio port as described herein in relation to a handheld communication device can be implemented with the ear phones illustrated in FIG. 8.

The method of providing the improved audio coupling will be described in the following paragraphs. For purposes of simplicity and clarity, the method will be described in relation to the handheld communication device 100 as depicted in at least FIGS. 1 and 6A-6C.

A method for increasing the audio coupling between the object 600 and the audio port 110 on the device 100 comprising the shape-adaptable surface 112 can include sensing the plurality of distances 620, 630 between the object 600 and the shape shape-adaptable surface 112 and controlling the plurality of portions 120 of the shape-adaptable surface 112 to adjust the plurality of distances 620, 630 and to form the channel 118 between the audio port 110 and the sound receiver 640 of the object 110, wherein the channel 118 directly couples the sound receiver 640 of the object 600 and the audio port 110. (See FIG. 6A). For example, as the object 600 approaches the device 100, the sensors 114 sense the presence of the object 600 and sense the plurality of distances 620, 630 between various points on the object 600 and portions of the shape-adaptable surface 112 of the device 110. In alternative embodiments, the object 600 can be an audio input device, a microphone, or the like.

In FIGS. 6A-6C, the object 600 is an ear of a user of the handheld communication device 100. As the ear approaches the handheld communication device 100, the sensors 114 sense the ear and begin sensing the distances 620, 630 between points on the ear and the plurality of portions 120 of the shape-adaptable surface 112. The processor controls the shape-adaptable surface 112 in response to the distances 620, 630 sensed by the plurality of sensors 114. The processor adjusts portions of the shape-adaptable surface 112 to create an auditory coupling between the ear and the shape-adaptable surface 112 to provide improved sound delivery from the audio port 110 to the ear.

Many objects are not uniform in shape or are not flat. So, the shape-adaptable surface 112 can be controlled and adjusted to conform to the shape of the object. For example, as illustrated in FIGS. 6A-6C, the ear has at least one of protrusions, ridges, valleys, concave portions, and convex portions. The processor can adjust the shape-adaptable surface 112 to contact points on the ear, thereby reducing certain gaps created between the protrusions, ridges, valleys, concave portions, and convex portions of the ear and the device 100. For example, the processor can control the shape-adaptable surface 112 to extend some of the plurality of portions 120 of the shape-adaptable surface 112 away from the device 100 in the direction of the ear, thereby reducing the gaps created by concave portions and valleys of the ear. The processor can also control the shape-adaptable surface 112 to retract some of the plurality of portions 120 of the shape-adaptable surface 112 away from the object 600 in the direction of the device 100 thereby relaxing any excess pressure placed on the shape-adaptable surface 112 by the convex portions and ridges of the ear. By relaxing the pressure, the shape-adaptable surface 112 is controlled to form an auditory coupling between the ear and the device 100 thereby improving sound quality and reducing the chance of muffled or dampened sounds that can result from the excess pressure placed between convex portions and ridges of the ear. Thus, with an active and reactive shape-adaptable surface 112, the ability to retract portions of the shape-adaptable surface 112 reduces the chance that a complete seal can be formed between the ridges and convex portions of the object 600 and the shape-adaptable surface 112 of the device 100 which can prevent or block sound travel to the sound receiver 640 of the object 600.

Additionally, the processor can control the shape-adaptable surface 112 to form the channel 118 between the sound receiver 640 of an object and the audio port 110 which can provide a direct path for sound to travel from the audio port 110 to the sound receiver 640. An exemplary embodiment of such a method can include making a determination that an area of the object 600 is the sound receiver 640. In response to the determination of the sound receiver 640, the method can include controlling the shape-adaptable surface 112 accordingly to form the acoustical channel 118 between the sound receiver 640 of the object 600 and the audio port 110. For example, if the object 600 is an ear, the processor can make a determination based on the sensed plurality of distances 620, 630 between the ear and the shape-adaptable surface 112 that the sound receiver 640 of the ear is the ear canal. The determination of the ear canal can be made by comparing the sensed distances 620, 630 to predetermined thresholds. For example, the processor can include a first predetermined threshold and a second predetermined threshold, where the second predetermined threshold is greater than the first. If a sensed distance 630 is determined to be greater than the second predetermined threshold, the processor can identify that the area of the ear at the sensed distance 630 that is greater than the second predetermined threshold is the ear canal. The processor can then determine and identify that the sensed distance 630 between the shape-adaptable surface 112 and the ear canal is a gap distance 630. The processor can then control and adjust the shape-adaptable surface 112 to increase the gap distance 630 between the ear canal and the shape-adaptable surface 112 to provide the channel 118 between the ear canal and audio port 110 for direct delivery of sound.

The sensors 114 can be used in conjunction with the processor to determine the plurality of distances 620, 630 between points of the object 600 and the plurality of portions 120 of the shape-adaptable surface 112. For example, the sensors 114 can be capacitance sensors. Some objects can carry an electrical charge which can be sensed by capacitance sensors. With capacitance sensors, the sensors 114 can determine the strength of the electrical charge which is correlated to the distance between the object 600 and the shape-adaptable surface 112. Thus, depending on the sensed distances 620, the processor can control the shape-adaptable surface 112 to reduce the distances 620 between the object 600 and the shape-adaptable surface 112 and can control the shape-adaptable surface 112 to form the direct channel 118 between the sound receiver 640 of the object 600 and the audio port 110 of the device 100. In alternative embodiments, the sensors 114 can be pressure sensors, strain gauges, resistive sensors piezoelectric sensors, displacement sensors or the like.

In another exemplary embodiment, the device 100 can have sensors 114 that are pressure sensors that can be coupled to various portions 120 of the shape-adaptable surface 112. The plurality of pressure sensors 114 can detect the amount of pressure placed on the shape-adaptable surface 112 by the object 600. Since the processor is coupled to the sensors 114, the processor can determine the plurality of distances 620, 630 between points on the object 600 and the plurality of portions 120 of the shape-adaptable surface 112 because pressure can be a function of the distance between the object 600 and the shape-adaptable surface 112. For example as illustrated in FIGS. 6A-6C, if the object 600 is an ear, the pressure sensors 114 can sense the convex portions and ridges of the ear because those portions will contact and exert pressure on the shape-adaptable surface 112. For the concave portions and valleys of the ear, the pressure sensors 114 can sense a zero pressure at those portions of the shape-adaptable surface 112. In response to zero pressures sensed by the sensors 114, the processor can control the shape-adaptable surface 112 to extend the portions of the shape-adaptable surface 112 until a non-zero pressure is sensed, which indicates the shape-adaptable surface 112 has contacted the ear. The processor can continue to extend portions of the shape-adaptable surface 112 until a first predetermined threshold is met. To determine which area of the object 600 is the sound receiver 640, the processor can extend the portion of the shape-adaptable surface 112 until a second predetermined threshold is exceeded. In such an embodiment, the second predetermined threshold is greater than the first predetermined threshold. When the processor determines that the second predetermined threshold is exceeded, the processor can determine and identify that that portion of the shape-adaptable surface 112 is attempting to contact the sound receiver 640 of the object 600. In response to the determination and identification of the sound receiver 640, the processor can control the shape-adaptable surface 112 to adjust the gap distance 630 between the shape-adaptable surface 112 and the sound receiver 640 to form the channel 118 between the audio port 110 and the sound receiver 640. For example, the processor can control the shape-adaptable surface 112 to increase the gap distance 630 between the audio port 110 and the sound receiver 640.

Regardless of the sensors 114 used, the processor can adjust the plurality of portions 120 of the shape-adaptable surface 112 to form the channel 118 between the audio port 110 and the sound receiver 640 of the object 600 based on the plurality of distances 620, 630 sensed by the sensors 114. In an alternative embodiment, the processor can transmit signals to a control portion 710 of the shape-adaptable surface 112 which in turn can excite certain portions 120 of the shape-adaptable surface 112 to retract towards the device 100 or can excite certain portions 120 to extend away from the device 100 depending on the distances 620, 630 sensed.

Aside from forming the channel 118 between the audio port 110 and the sound receiver 640 of the object 600, the device 100 having the shape-adaptable surface 112 for the audio port 110 can utilize the sensors 114 and configure the processor to sense and detect the perimeter 660 of the object 600. For example, FIG. 6D illustrates an exemplary embodiment of the object 600 that is an ear having the perimeter 660. In another alternative embodiment illustrated in FIG. 6E, the processor can be further configured to control the plurality of portions 120 of the shape-adaptable surface 112 that are proximate to the perimeter 660 of the object 600. For example, the plurality of sensors 114 can sense a plurality of distances 620 between the points on the perimeter 660 of the object 600 and the plurality of portions 120 of the shape-adaptable surface 112. Since the sensors 114 are coupled to the processor, the processor can be configured to determine or detect the perimeter 660 of the object 600 based on the plurality of distances 620 sensed by the sensors 114. As illustrated in FIG. 6E, in response to the detection of the perimeter 660, the processor can adjust the plurality of distances 620 by either extending or retracting the portions 120 of the shape-adaptable surface 112 that are proximate to the perimeter 660 of the object 600 to create an audio coupling or a seal between the perimeter 660 of the object 600 and the shape-adaptable surface 112. With an audio coupling around the perimeter 660 of the object 600, sound from the audio port 110 is less likely to escape from the audio coupling, thereby ensuring delivery of sound to the audio receiver 640 of the object 600 without reduced sound quality. The audio coupling around the perimeter 660 of the object 600 can also be made in addition to the direct audio channel 118 between the audio receiver 640 and the audio port 110 thereby further ensuring direct delivery of sound to the object 600, wherein the sound is of essentially undiminished quality.

Thus, the method for providing an improved audio coupling between the object 600 and the audio port 110 on the device 100 comprising the shape-adaptable surface 112 can include sensing the plurality of distances 620, 630 between the object 600 and the shape-adaptable surface 112 and controlling the plurality of portions 120 of the shape-adaptable surface 112 to adjust the plurality of distances 620, 630 and to form the channel 118 between the audio port 110 and the sound receiver 640 of the object 110, wherein the channel 118 directly couples the sound receiver 640 of the object 600 and the audio port 110. The plurality of sensors 114 coupled to the shape-adaptable surface 112 and the processor can be used to sense the plurality of distances 620, 630 between the object 600 and the shape-adaptable surface 112. In response to the sensed plurality of distances 620, 630 the processor can send signals to a control portion 710 that controls the plurality of portions 120 of the shape-adaptable surface 112. For example, the processor can control the shape-adaptable surface 112 to retract some of the plurality of portions away from the object 600 in the direction of the device or extend some of the plurality of portions away from the device 100 in the direction of the object 600. By making these adjustments, the processor shapes the shape-adaptable surface 112 to reduce the gaps between the shape-adaptable surface 112 and the object 600. As a result, an audio coupling can be formed to allow sound from the audio port 110 to the sound receiver 640 of the object 600. Additionally, some of the plurality of portions of shape-adaptable surface 112 can be extended or retracted to form the channel 118 between the audio port 110 and the sound receiver 640 which can provide a less obstructed path for sound to travel from the audio port 110 to the sound receiver 640.

Figure 10:
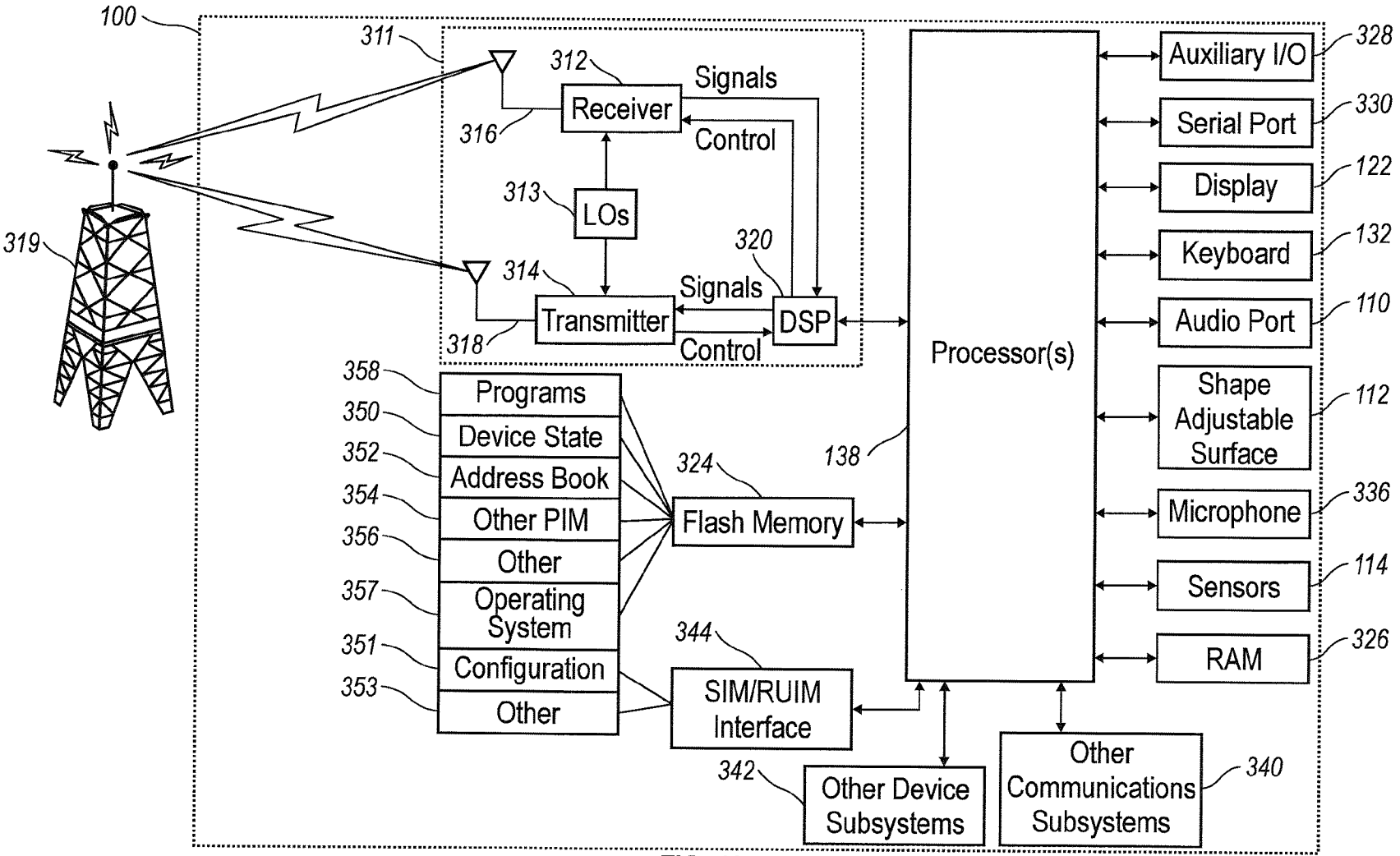
FIG. 10 is a block diagram illustrating the communication between an electronic device and a processor coupled with a shape-adaptable surface for an audio port in accordance with an exemplary embodiment.

FIG. 10 is a block diagram of the handheld communication device 100 depicted in at least FIG. 1 that includes a processor module 138 that controls the operation of the communication device 100. A communication subsystem 311 performs all communication transmission and reception with the wireless network 319. The processor module 138 further can be connected with an auxiliary input/output (I/O) subsystem 328 which can be connected to the communication device 100. In at least one embodiment, the processor module 138 can be connected to a serial port (for example, a Universal Serial Bus port) 330 which can allow for communication with other devices or systems. The display 122 can be connected to the processor module 138 to allow for displaying of information to an operator of the communication device 100. When the communication device 100 is equipped with the keyboard 132, the keyboard 132 can also be connected with the processor module 138. In the presently described embodiment, a keyboard controller is in communication with the processor in order to send or relay messages corresponding to key pressings of the keyboard 132 to the processor 138. The communication device 100 can include the audio port 110, a microphone 336, random access memory (RAM) 326, and flash memory 324, all of which can be connected to the processor module 138. Other similar components can be provided on the device 100 as well and optionally connected to the processor module 138. Other communication subsystems 340 and other communication device subsystems 342 are generally indicated as being functionally connected with the processor module 138 as well. An example of a communication subsystem 340 is that of a short range communication system such as BLUETOOTH® communication module or a WI-FI® communication module (a communication module in compliance with IEEE 802.11 set of protocols) and associated circuits and components. The processor module 138 is able to perform operating system functions and enables execution of programs on the communication device 100. In some embodiments not all of the above components can be included in the communication device 100. For example, in at least one embodiment the keyboard 132 is not provided as a separate component, and is displayed as required on a dynamic touch display. In an embodiment having a dynamic touch display, the keyboard 132 can be displayed as a touchscreen keyboard. A touchscreen module can be incorporated in such an embodiment such that it is in communication with the processor 138. When inputs are received on the touchscreen keyboard, the touchscreen module can send or relay messages corresponding to those inputs to the processor.

The auxiliary I/O subsystem 328 can take the form of a trackball navigation tool as illustrated in the exemplary embodiment shown in FIG. 1, or a thumbwheel, a navigation pad, a joystick, touch-sensitive interface, or other I/O interface. While the above examples have been provided in relation to the auxiliary I/O subsystem 328, other subsystems capable of providing input or receiving output from the communication device 100 are considered within the scope of this disclosure. Other keys can be placed along the side of the communication device 100 to function as escape keys, volume control keys, scrolling keys, power switches, or user programmable keys, and can likewise be programmed accordingly.

Furthermore, the communication device 100 is equipped with components to enable operation of various programs, as shown in FIG. 10. In an exemplary embodiment, the flash memory 324 is enabled to provide a storage location for the operating system 357, device programs 358, and data. The operating system 357 is generally configured to manage other programs 358 that are also stored in memory 324 and executable on the processor. The operating system 357 honors requests for services made by programs 358 through predefined program 358 interfaces. More specifically, the operating system 357 typically determines the order in which multiple programs 358 are executed on the processor and the execution time allotted for each program 358, manages the sharing of memory 324 among multiple programs 358, handles input and output to and from other device subsystems 342, and so on. In addition, operators can typically interact directly with the operating system 357 through a user interface which can include the keyboard 132 and display screen 122. While in an exemplary embodiment the operating system 357 is stored in flash memory 324, the operating system 357 in other embodiments is stored in read-only memory (ROM) or similar storage element (not shown). As those skilled in the art will appreciate, the operating system 357, device program 358 or parts thereof can be loaded in RAM 326 or other volatile memory.

In one exemplary embodiment, the flash memory 324 contains programs 358 for execution on the communication device 100 including an address book 352, a personal information manager (PIM) 354, and the device state 350. Furthermore, programs 358 and other information 356 including data can be segregated upon storage in the flash memory 324 of the communication device 100.

When the communication device 100 is enabled for two-way communication within the wireless communication network 319, it can send and receive messages from a mobile communication service. Examples of communication systems enabled for two-way communication include, but are not limited to, the General Packet Radio Service (GPRS) network, the Universal Mobile Telecommunication Service (UMTS) network, the Enhanced Data for Global Evolution (EDGE) network, the Code Division Multiple Access (CDMA) network, High-Speed Packet Access (HSPA) networks, Universal Mobile Telecommunication Service Time Division Duplexing (UMTS-TDD), Ultra Mobile Broadband (UMB) networks, Worldwide Interoperability for Microwave Access (WiMAX), and other networks that can be used for data and voice, or just data or voice. For the systems listed above, the communication device 100 can require a unique identifier to enable the communication device 100 to transmit and receive messages from the communication network 319. Other systems may not require such identifying information. GPRS, UMTS, and EDGE use a Subscriber Identity Module (SIM) in order to allow communication with the communication network 319. Likewise, most CDMA systems use a Removable User Identity Module (RUIM) in order to communicate with the CDMA network. The RUIM and SIM card can be used in multiple different communication devices 100. The communication device 100 can be able to operate some features without a SIM/RUIM card, but it will not be able to communicate with the network 319. A SIM/RUIM interface 344 located within the communication device 100 allows for removal or insertion of a SIM/RUIM card (not shown). The SIM/RUIM card features memory and holds key configurations 351, and other information 353 such as identification and subscriber related information. With a properly enabled communication device 100, two-way communication between the communication device 100 and communication network 319 is possible.

If the communication device 100 is enabled as described above or the communication network 319 does not require such enablement, the two-way communication enabled communication device 100 is able to both transmit and receive information from the communication network 319. The transfer of communication can be from the communication device 100 or to the communication device 100. In order to communicate with the communication network 319, the communication device 100 in the presently described exemplary embodiment is equipped with an integral or internal antenna 318 for transmitting messages to the communication network 319. Likewise the communication device 100 in the presently described exemplary embodiment is equipped with another antenna 316 for receiving communication from the communication network 319. These antennae (316, 318) in another exemplary embodiment are combined into a single antenna (not shown). As one skilled in the art would appreciate, the antenna or antennae (316, 318) in another embodiment are externally mounted on the communication device 100.

When equipped for two-way communication, the communication device 100 features a communication subsystem 311. As is understood in the art, this communication subsystem 311 is modified so that it can support the operational needs of the communication device 100. The subsystem 311 includes a transmitter 314 and receiver 312 including the associated antenna or antennae (316, 318) as described above, local oscillators (LOs) 313, and a processing module 320 which in the presently described exemplary embodiment is a digital signal processor (DSP) 320.

It is contemplated that communication by the communication device 100 with the wireless network 319 can be any type of communication that both the wireless network 319 and communication device 100 are enabled to transmit, receive and process. In general, these can be classified as voice and data. Voice communication generally refers to communication in which messages for audible sounds are transmitted by the communication device 100 through the communication network 319. Data generally refers to all other types of communication that the communication device 100 is capable of performing within the constraints of the wireless network 319.

Example device programs that can depend on such data include email, contacts and calendars. For each such program, synchronization with home-based versions of the programs can be desirable for either or both of their long term and short term utility. As an example, emails are often time sensitive, so substantially real time synchronization can be desired. Contacts, on the other hand, can be usually updated less frequently without inconvenience. Therefore, the utility of the communication device 100 is enhanced when connectable within a communication system, and when connectable on a wireless basis in the network 319 in which voice, text messaging, and other data transfer are accommodated.

Although the above-described method has been described in relation to shape-adaptable surface for the audio port 110 of the handheld communication device 100, one of ordinary skill in the art will appreciate that the method can be implemented in any other electronic device that has an audio port 110. For example, the shape-adaptable surface 112 can be implemented into the ear pieces of noise-canceling headphones to improve the audio coupling between the user's ear and the audio port of the noise canceling headphones to ensure extraneous noise is blocked out and to ensure a direct path between the user's ear canal and the audio port. The shape-adaptable surface can also be implemented into the speaker portions of walkie-talkies. Shape-adaptable surface can also be implemented around plug connections for speakers or audio outputs to ensure a direct audio coupling for sound to travel from the audio port to and through the plug.

Exemplary embodiments have been described hereinabove regarding the implementation of shape-adaptable surface with an audio port to provide an improved audio coupling. However, one of ordinary skill in the art will appreciate that the method can be implemented on other devices, such as ear buds, walkie-talkies, portable audio players, portable video players, PDAs, cellphones, or other devices utilizing audio ports that transmit sound via an audio coupling to an audio receiver. One of ordinary skill in the art will also appreciate that the method can be performed by devices other than a processor, such as a hardware component, a hardware driver, an API, or other similar devices and components. Various modifications to and departures from the disclosed embodiments will occur to those having skill in the art. The subject matter that is intended to be within the spirit of this disclosure is set forth in the following claims.

What is claimed is:

1. A device comprising at least one of a mobile communication device and a handset, the device comprising:

an audio port;

a shape-adaptable surface having a plurality of portions;

a plurality of sensors coupled to the shape-adaptable surface, wherein the plurality of sensors are operative to sense a plurality of distances between an ear and the shape-adaptable surface;

a processor operatively coupled to the shape-adaptable surface and to the plurality of sensors, said processor configured to control some of the plurality of portions of the shape adaptable surface to adjust the plurality of distances such that at least part of the shape adaptable surface is brought into contact with the ear and at least part of the shape adaptable surface is maintained retracted from the ear to thereby provide a channel formed by both the ear and the shape adaptable surface between a sound receiver of the ear and the audio port.

2. The device of claim 1, wherein said plurality of sensors are capacitive sensors.

3. The device of claim 1, wherein said shape-adaptable surface comprises an electroactive polymer.

4. The device of claim 1, wherein said processor is further configured to detect a perimeter of the ear.

5. The device of claim 4, wherein said processor is further configured to reduce the plurality of distances between the plurality of portions proximate to the perimeter of the object ear and the perimeter of the object ear.

6. The device of claim 1, wherein said processor controls the plurality of portions by extending some of the plurality of portions away from the device in the direction of the ear.

7. The device of claim 1, wherein said processor controls the plurality of portions by retracting some of the plurality of portions away from the ear in the direction of the device.

8. The device of claim 1, wherein said processor controls the plurality of portions of the shape-adaptable surface by transmitting signals to a control portion of the shape-adaptable surface.

9. The device of claim 1, wherein said channel is formed by retracting the portions of the shape-adaptable surface between the audio port and the sound receiver towards the device.

10. The device of claim 1, wherein the processor is further configured to:

adjust at least one of the plurality of portions of the shape-adaptable surface to reduce at least one of the plurality of distances in response to the at least one distance being greater than a first predetermined threshold; and adjust at least one other portion of the plurality of portions to increase a gap distance between the ear and the shape-adaptable surface in response to a distance between the sound receiver and the shape-adaptable surface being greater than a second predetermined threshold, wherein said second predetermined threshold is greater than the first predetermined threshold;

said gap distance providing the channel in said shape-adaptable surface to directly couple the sound receiver and the audio port.

11. A method for increasing the audio coupling between an ear and an audio port on a device comprising at least one of a mobile communication device and a handset, the device also comprising a shape-adaptable surface, said method comprising:

sensing a plurality of distances between the ear and the shape-adaptable surface; and controlling a plurality of portions of the shape-adaptable surface to adjust the plurality of distances such that at least part of the shape-adaptable surface is brought into contact with the ear and at least part of the shape-adaptable surface is maintained retracted from the ear to thereby provide a channel formed by both the ear and the shape adaptable surface between the audio port and a sound receiver of said ear, wherein the channel directly couples the sound receiver of the ear and the audio port.

12. The method of claim 11, wherein said sensing the plurality of distances between the ear includes receiving signals from the plurality of sensors indicative of the ear being positioned against an outer surface coupled to the shape-adaptable surface.

13. The method of claim 11, wherein controlling the plurality of portions includes retracting the plurality of portions away from the ear in the direction of the device.

14. The method of claim 11, wherein said controlling the plurality of portions includes extending the plurality of portions away from the device in the direction of the ear.

15. The method of claim 11, wherein said controlling the plurality of portions of the shape-adaptable surface includes transmitting signals to a control portion of the shape-adaptable surface.

16. The method of claim 11, wherein said sound receiver is an ear canal of a user of the device.

17. The method of claim 11, wherein said channel is formed by retracting the shape-adaptable surface between the audio port and the sound receiver.

18. The method of claim 11 further comprising detecting a perimeter of the ear.

19. The method of claim 18, wherein said controlling the plurality of portions of the shape-adaptable surface is limited to reducing the distance between the plurality of portions proximate to the perimeter of the ear and the perimeter of the ear.

* * * * *